US011090926B2

(12) United States Patent
Ng et al.

(10) Patent No.: US 11,090,926 B2
(45) Date of Patent: Aug. 17, 2021

(54) DECODERS FOR MEMORIES OF FLUID EJECTION DEVICES

(71) Applicant: HEWLETT-PACKARD DEVELOPMENT COMPANY, L.P., Spring, TX (US)

(72) Inventors: Boon Bing Ng, Vancouver, WA (US); Rui Pan, Singapore (SG); Mohan Kumar Sudhakar, Singapore (SG); Hang Ru Goy, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/608,061

(22) PCT Filed: Jul. 6, 2017

(86) PCT No.: PCT/US2017/040877
§ 371 (c)(1),
(2) Date: Oct. 24, 2019

(87) PCT Pub. No.: WO2019/009902
PCT Pub. Date: Jan. 10, 2019

(65) Prior Publication Data
US 2021/0094281 A1 Apr. 1, 2021

(51) Int. Cl.
*B41J 2/045* (2006.01)

(52) U.S. Cl.
CPC ..... *B41J 2/04541* (2013.01); *B41J 2/0455* (2013.01); *B41J 2/0458* (2013.01)

(58) Field of Classification Search
CPC ..... B41J 2/04541; B41J 2/0455; B41J 2/0458
See application file for complete search history.

(56) References Cited

U.S. PATENT DOCUMENTS

| | | | | |
|---|---|---|---|---|
| 4,047,163 | A | 9/1977 | Choate | |
| 5,297,085 | A * | 3/1994 | Choi | G11C 29/808 365/200 |
| 6,439,697 | B1 | 8/2002 | Axtell et al. | |
| 7,278,703 | B2 | 10/2007 | Benjamin et al. | |
| 7,372,475 | B2 | 5/2008 | Vazac et al. | |

(Continued)

FOREIGN PATENT DOCUMENTS

| | | |
|---|---|---|
| EP | 0116464 | 8/1984 |
| GB | 1488271 | 10/1977 |

(Continued)

OTHER PUBLICATIONS

Andrews, K. et al. A Theory of Interleavers, May 29, 2012 <https://www.cs.cornell.edu/~kozen/papers/interl.pdf >.

(Continued)

*Primary Examiner* — Jason S Uhlenhake
(74) *Attorney, Agent, or Firm* — Trop Pruner & Hu PC

(57) ABSTRACT

In some examples, a circuit for use with a fluid ejection device includes a plurality of decoders responsive to a common address to activate respective control signals at different times for selecting respective memories of the fluid ejection device. Each respective decoder of the plurality of decoders comprising a discharge switch to deactivate a control signal of the respective decoder while another decoder of the plurality of decoders is activating a control signal in response to the common address.

20 Claims, 15 Drawing Sheets

(56) References Cited

U.S. PATENT DOCUMENTS

| | | | |
|---|---|---|---|
| 7,497,536 | B2 | 3/2009 | Benjamin |
| 8,474,943 | B2 | 7/2013 | Ness et al. |
| 8,717,206 | B2 | 5/2014 | Geerlings |
| 8,745,433 | B2 | 6/2014 | Sato |
| 8,864,260 | B1 | 10/2014 | Ge et al. |
| 9,592,664 | B2 | 3/2017 | Ge et al. |
| 2005/0190217 | A1 | 9/2005 | Wade |
| 2008/0172515 | A1 | 7/2008 | Croxford |
| 2009/0147035 | A1 | 6/2009 | Nakano |
| 2010/0302293 | A1 | 12/2010 | Torgerson et al. |
| 2016/0332439 | A1 | 11/2016 | Ge et al. |
| 2018/0264808 | A1* | 9/2018 | Bakker ..... B41J 2/04588 |

FOREIGN PATENT DOCUMENTS

| | | |
|---|---|---|
| WO | WO-2015116129 | 8/2015 |
| WO | WO-2015167477 | 11/2015 |
| WO | WO-2016018199 | 2/2016 |
| WO | WO-2016167763 | 10/2016 |
| WO | WO-2019009903 | 1/2019 |

OTHER PUBLICATIONS

Zwang, D., Drupa 2012, the Inkjet Drupa again? a Closer Look at Xerox, Nov. 28, 2011, <http://whattheythink.com/articles/55245-drupa-2012-inkjet-drupaagain-closer-look-xerox/.

* cited by examiner

DECODERS FOR MEMORIES OF FLUID EJECTION DEVICES

BACKGROUND

A printing system can include a printhead that has nozzles to dispense printing fluid to a target. In a two-dimensional (2D) printing system, the target is a print medium, such as a paper or another type of substrate onto which print images can be formed. Examples of 2D printing systems include inkjet printing systems that are able to dispense droplets of inks. In a three-dimensional (3D) printing system, the target can be a layer or multiple layers of build material deposited to form a 3D object.

BRIEF DESCRIPTION OF THE DRAWINGS

Some implementations of the present disclosure are described with respect to the following figures.

Figure 1:
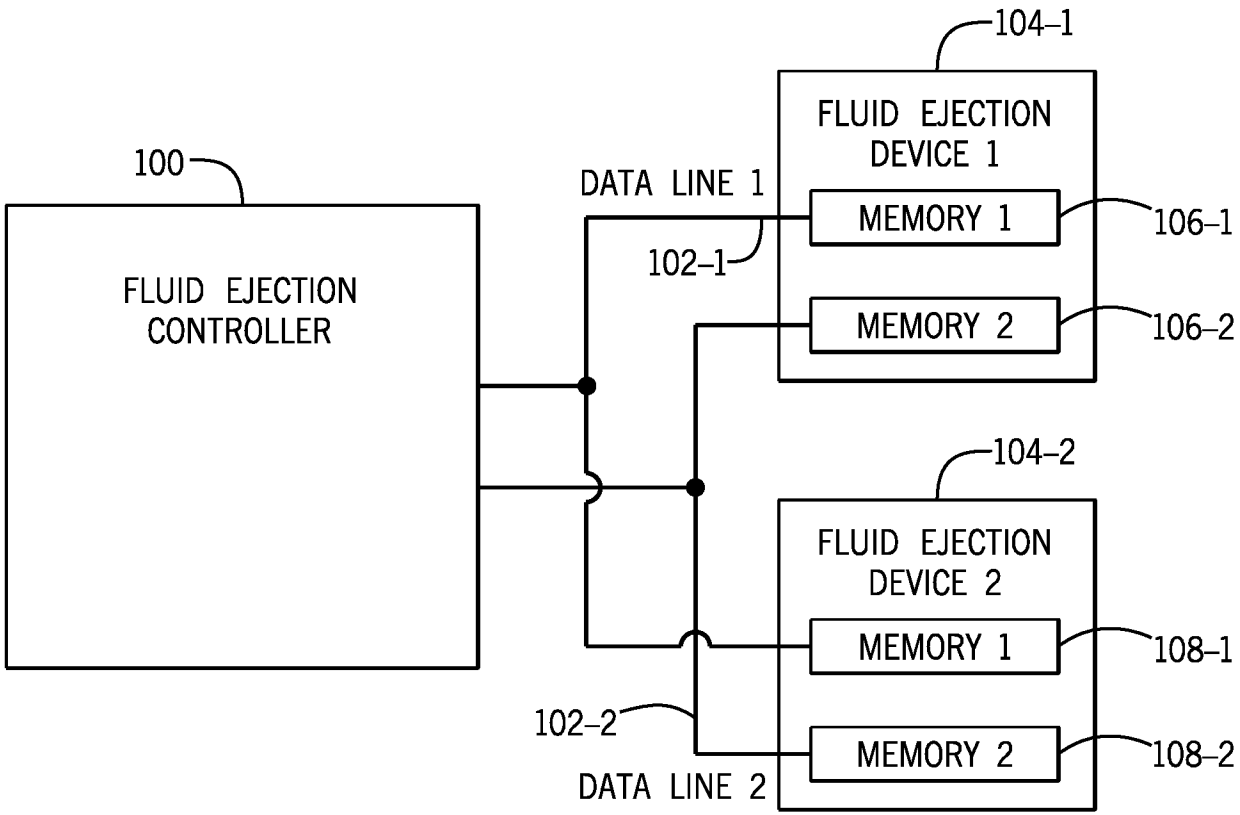
FIGS. 1 and 2 are block diagrams of systems each including a fluid ejection controller and fluid ejection devices, according to some examples.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

In the present disclosure, use of the term "a," "an", or "the" is intended to include the plural forms as well, unless the context clearly indicates otherwise. Also, the term "includes," "including," "comprises," "comprising," "have," or "having" when used in this disclosure specifies the presence of the stated elements, but do not preclude the presence or addition of other elements.

A printhead for use in a printing system can include nozzles that are activated to cause printing fluid droplets to be ejected from respective nozzles. Each nozzle includes a nozzle activation element. The nozzle activation element when activated causes a printing fluid droplet to be ejected by the corresponding nozzle. In some examples, a nozzle activation element includes a heating element (e.g., a thermal resistor) that when activated generates heat to vaporize a printing fluid in a firing chamber of the nozzle. The vaporization of the printing fluid causes expulsion of a droplet of the printing fluid from the nozzle. In other examples, a nozzle activation element includes a piezoelectric element. When activated, the piezoelectric element applies a force to eject a printing fluid droplet from a nozzle. In further examples, other types of nozzle activation elements can be employed.

A printing system can be a two-dimensional (2D) or three-dimensional (3D) printing system. A 2D printing system dispenses printing fluid, such as ink, to form images on print media, such as paper media or other types of print media. A 3D printing system forms a 3D object by depositing successive layers of build material. Printing fluids dispensed from the 3D printing system can include ink, as well as agents used to fuse powders of a layer of build material, detail a layer of build material (such as by defining edges or shapes of the layer of build material), and so forth.

In the ensuing discussion, the term "printhead" can refer generally to a printhead die or an overall assembly that includes multiple printhead dies mounted on a support structure. A die (also referred to as an "integrated circuit (IC) die") includes a substrate on which is provided various layers to form nozzles and control circuitry to control ejection of a fluid by the nozzles.

Although reference is made to a printhead for use in a printing system in some examples, it is noted that techniques or mechanisms of the present disclosure are applicable to other types of fluid ejection devices used in non-printing applications that are able to dispense fluids through nozzles. Examples of such other types of fluid ejection devices include those used in fluid sensing systems, medical systems, vehicles, fluid flow control systems, and so forth.

In some examples, a fluid ejection device can be implemented with one die. In further examples, a fluid ejection device can include multiple dies.

As devices, including printhead dies or other types of fluid ejection dies, continue to shrink in size, the number of signal lines used to control circuitry of a device can affect the overall size of the device. A large number of signal lines can lead to using a large number of signal pads (referred to as "bond pads") that are used to electrically connect the signal lines to external lines. Adding features to fluid ejection devices can lead to use of an increased number of signal lines (and corresponding bond pads), which can take up valuable die space, for example. Examples of additional features that can be added to a fluid ejection device include memory devices.

An issue associated with accessing memory in a fluid ejection device is that an address space available given a particular number of address lines connected to the fluid ejection device is restricted. Without increasing the number of address lines over the particular number of address lines, the fluid ejection device may not be able to support a larger memory to store more data. In addition, bandwidth for accessing data (reading data or writing data) of the memory in the fluid ejection device can also be constrained, which can lead to slow operation when data access is to be performed.

Techniques or mechanisms according to various implementations can be employed to address the foregoing. In some implementations (referred to as "multi-data line implementations"), a multi-data line arrangement can be used where multiple data lines (e.g., ID lines) connected to a fluid ejection controller are shared by memories in multiple fluid ejection devices. As used here, the term "line" can refer to an electrical conductor (or alternatively, multiple electrical conductors) that can be used to carry a signal (or multiple signals).

In alternative implementations of the present disclosure, techniques or mechanisms for interleaved memory access (or more simply, "interleaved access") can be employed. In the alternative implementations (referred to as "interleaved access implementations"), multiple decoders (that include shift registers in some examples) are used to control selection of respective memories of a fluid ejection device. The multiple decoders can cause activation of control signals at different times in response to a common address, for selecting respective memories of the fluid ejection device for interleaved access. To control durations of the control signals produced by the multiple decoders, respective pass gates and discharge switches can be included in the respective decoders. The discharge switch in each respective decoder deactivates a control signal of the respective decoder while another decoder of the plurality of decoders is activating a control signal in response to the common address.

In yet further implementations of the present disclosure, a multi-data line implementation can be combined with an interleaved access implementation to provide an even greater address space, given a specific set of address lines.

Multi-Data Line Implementations

This section refers to examples of multi-data line implementations.

As shown in FIG. 1, a fluid dispensing system includes a fluid ejection controller 100 that is used to control fluid ejection devices 104-1 and 104-2. For example, in a printing system, the fluid ejection controller can include a printhead controller, and the fluid ejection devices 104-1 and 104-2 can include printhead devices to deliver ink or another agent in a 2D or 3D printing system.

A "controller" can refer to a hardware processing circuit, such as any or some combination of the following: a microprocessor, a core of a multi-core microprocessor, a microcontroller, a programmable integrated circuit device, a programmable gate array, and so forth. A controller can be implemented with one IC chip (or die) or multiple IC chips (or dies). In further examples, a microcontroller can refer to a combination of a hardware processing circuit and machine-readable instructions (software and/or firmware) executable on the hardware processing circuit.

The fluid ejection controller 100 generates various control signals and address signals that are transported over lines to the fluid ejection devices 104-1 and 104-2. In addition, the fluid ejection controller 100 can write data to the fluid ejection devices 104-1 and 104-2 over data lines, and read data from the fluid ejection devices 104-1 and 104-2 over data lines.

In some examples, multiple data lines 102-1 and 102-2 are shared by multiple fluid ejection devices 104-1 and 104-2. For example, a first data line 102-1 communicates data of a first memory 106-1 or 108-1 of each fluid ejection device, and a second data line 102-2 communicates data of a second memory 106-2 or 108-2 of each fluid ejection device. Thus, the data of the memories 106-1 and 106-2 in the fluid ejection device 104-1 can be communicated in parallel over the data lines 102-1 and 102-2. Similarly, the data of the memories 108-1 and 108-2 in the fluid ejection device 104-2 can be communicated in parallel over the data lines 102-1 and 102-2.

In some examples, each memory 106-1, 106-2, 108-1, or 108-2 can be implemented as an electrically programmable read-only memory (EPROM) or another type of memory, such as a memristor memory, a phase change memory, and so forth.

A first end of the data line 102-1 is connected to memories 106-1 and 108-1 of the respective fluid ejection devices 104-1 and 104-2. Similarly, a first end of the data line 102-2 is connected to memories 106-2 and 108-2 of the respective fluid ejection devices 104-1 and 104-2. The second ends of the data lines 102-1 and 102-2 are connected to the fluid ejection controller 100.

The memories 106-1 and 106-2 (and similar memories 108-1 and 108-2) can be implemented as separate memory devices or as part of different portions of one memory device.

Although a specific number of data lines, fluid ejection devices, and memories are depicted in FIG. 1, it is noted that in other examples, more than two data lines can be connected between the fluid ejection controller 100 and fluid ejection devices, for connection to respective more than two fluid ejection devices. The multiple data lines (two or more) can generally be connected to respective multiple (two or more) memories.

In FIG. 1, each fluid ejection device 104-1 or 104-2 can be implemented using one die or multiple dies. In examples where a fluid ejection device is implemented with one die, the memories of the fluid ejection device are all provided on the one die. In examples where a fluid ejection device is implemented with multiple dies, the memories of the fluid ejection device can be provided on the multiple dies.

In FIG. 1, the data lines 102-1 and 102-2 shared by multiple fluid ejection devices 104-1 and 104-2 can form a circuit. The circuit can be provided on a flex cable, a circuit board, or any other structure between the fluid ejection controller 100 and the fluid ejection devices 104-1 and 104-2. The circuit can be separate from or part of a fluid ejection device. Alternatively, the circuit can be separate from or part of the fluid ejection controller 100.

A given set of address lines connected to a particular fluid ejection device supports an address space of a first size. Use of multiple data lines to communicate data of the multiple memories of the particular fluid ejection device in parallel effectively increases an available address space to a size greater than the first size (e.g., use of two data lines to communicate data of memories in parallel effectively doubles the address space). Additionally, use of multiple data lines to communicate data of the multiple memories of the particular fluid ejection device in parallel increases the bandwidth of accessing data of the particular fluid ejection device, as compared to an available bandwidth where just one data line is used to communicate data of the particular fluid ejection device.

Figure 2:
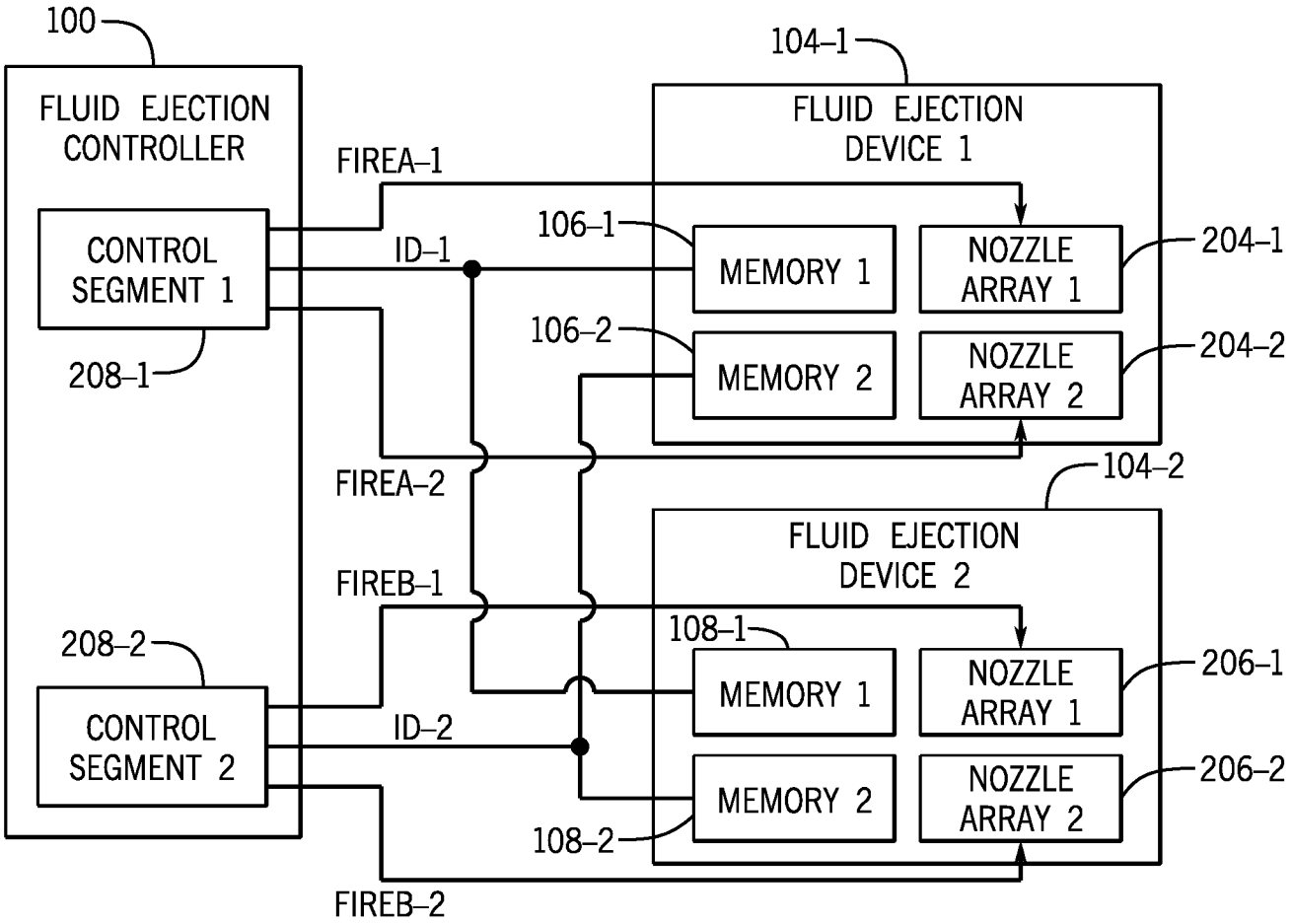

FIG. 2 is a block diagram of an example fluid dispensing system that includes a fluid ejection controller 100 and fluid ejection devices 104-1 and 104-2. The fluid ejection device 104-1 includes the memories 106-1 and 106-2 as well as nozzle arrays 204-1 and 204-2. The nozzle arrays 204-1 and 204-2 can be separate sets of nozzles, or alternatively, can be two different portions of the same set of nozzles. Each nozzle can include a nozzle activation element, a fluid chamber, and a fluid orifice. When the nozzle activation element is activated, fluid in the fluid chamber is ejected through the fluid orifice of the nozzle. In some examples, the nozzle activation element can include a thermal resistor that heats up the fluid in the fluid chamber to cause vaporization of fluid chamber, to cause ejection of fluid through the fluid orifice. In other examples, the nozzle activation element can include a piezoelectric element that when activated applies a mechanical force to cause ejection of fluid through the fluid orifice. In further examples, other types of nozzle activation elements can be used.

The fluid ejection device 104-2 includes the memories 108-1 and 108-2 as well as nozzle arrays 206-1 and 206-2.

The fluid ejection controller 100 is divided into two control segments 208-1 and 208-2 (or more than two control segments in examples where there are more than two fluid ejection devices). The control segment 208-1 is used to control activation of nozzles of the fluid ejection device 104-1, while the control segment 208-2 is to control activation of nozzles of the fluid ejection device 104-2. The control segments 208-1 and 208-2 can include substantially similar circuitry, except that they are used to control activation of respective different nozzles in different fluid ejection devices.

The control segment 208-1 outputs fire signals FIREA-1 and FIREA-2, which are provided over respective fire lines to the fluid ejection device 104-1. The signal FIREA-1 controls activation of the nozzle array 204-1, and the fire signal FIREA-2 controls activation of the nozzle array 204-2.

The memories 106-1 and 106-2 in some examples are ID memories, which are used to store identification data (and other data). The identification data can identify the respective fluid ejection device. As such, the data line that is output by the control segment 208-1 is referred to as an ID line, which can be used to write or read identification data as well as other data in a respective memory.

The control segment 208-1 is connected over an ID-1 line to the memory 106-1 of the fluid ejection device 104-1. However, the memory 106-2 of the fluid ejection device 104-1 is connected to an ID line of the control segment 208-2, and more specifically, the ID-2 line that interconnects the control segment 208-2 and the memory 106-2.

The control segment 208-2 further produces two fire signals, FIREB-1 and FIREB-2, which are provided over fire lines to respective nozzle arrays 206-1 and 206-2 of the fluid ejection device 104-2, to control activation of the nozzle arrays 206-1 and 206-2. The ID-2 line interconnects the control segment 208-2 and the memory 108-2 in the fluid ejection device 104-2. However, the memory 108-1 of the fluid ejection device 104-2 is connected over the ID-1 line to the control segment 208-1.

In the arrangement shown in FIG. 2, it can be seen that the ID line of each control segment is not dedicated to just a single fluid ejection device. Rather, the ID line of each control segment 208-1 or 208-2 is shared by multiple fluid ejection devices.

Figure 3:
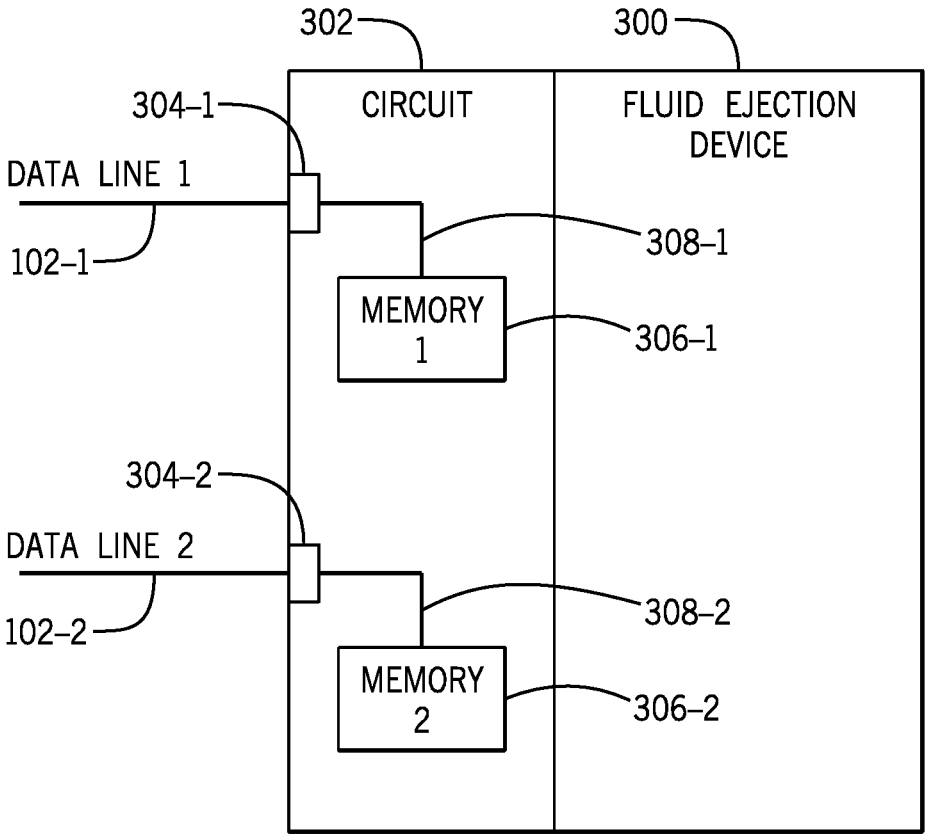
FIGS. 3 and 4 are block diagrams of arrangements each including a fluid ejection device according to various examples.

FIG. 3 is a block diagram of an example arrangement that includes a fluid ejection device 300 and a circuit 302 for the fluid ejection device 300. The circuit 302 can be part of or separate from the fluid ejection device 300. In some examples, the fluid ejection device 300 can include a fluid ejection die (or multiple fluid ejection dies). The circuit 302 can be part of the fluid ejection die, or alternatively, the circuit 302 can be part of a die that is separate from the fluid ejection die. As further examples, the circuit 302 can be part of another structure, such as a flexible cable, a circuit board, or other type of support structure. The circuit 302 includes bond pads 304-1 and 304-2. The bond pads 304-1 and 304-2 are electrically connected to corresponding data lines 102-1 and 102-2, which can be connected to the fluid ejection controller 202 (FIG. 2), for example.

The circuit 302 further includes memories 306-1 and 306-2. Alternatively, the memories 306-1 and 306-2 can be part of the fluid ejection device 300. The memory 306-1 is connected over a path 308-1 to the bond pad 304-1, and the memory 306-2 is connected over a path 308-2 to the bond pad 304-2. Each path 308-1 or 308-2 can be formed using electrical conductors (e.g., electrically conductive traces, wires, etc.) that interconnect the bond pad 304-1 or 304-2 and the memory 306-1 or 306-2. Alternatively, each path 308-1 or 308-2 can include intermediate devices, such as amplifiers, filters, and so forth, through which signals communicated between the bond pad 304-1 or 304-2 and memory 306-1 or 306-2 are propagated.

Figure 4:
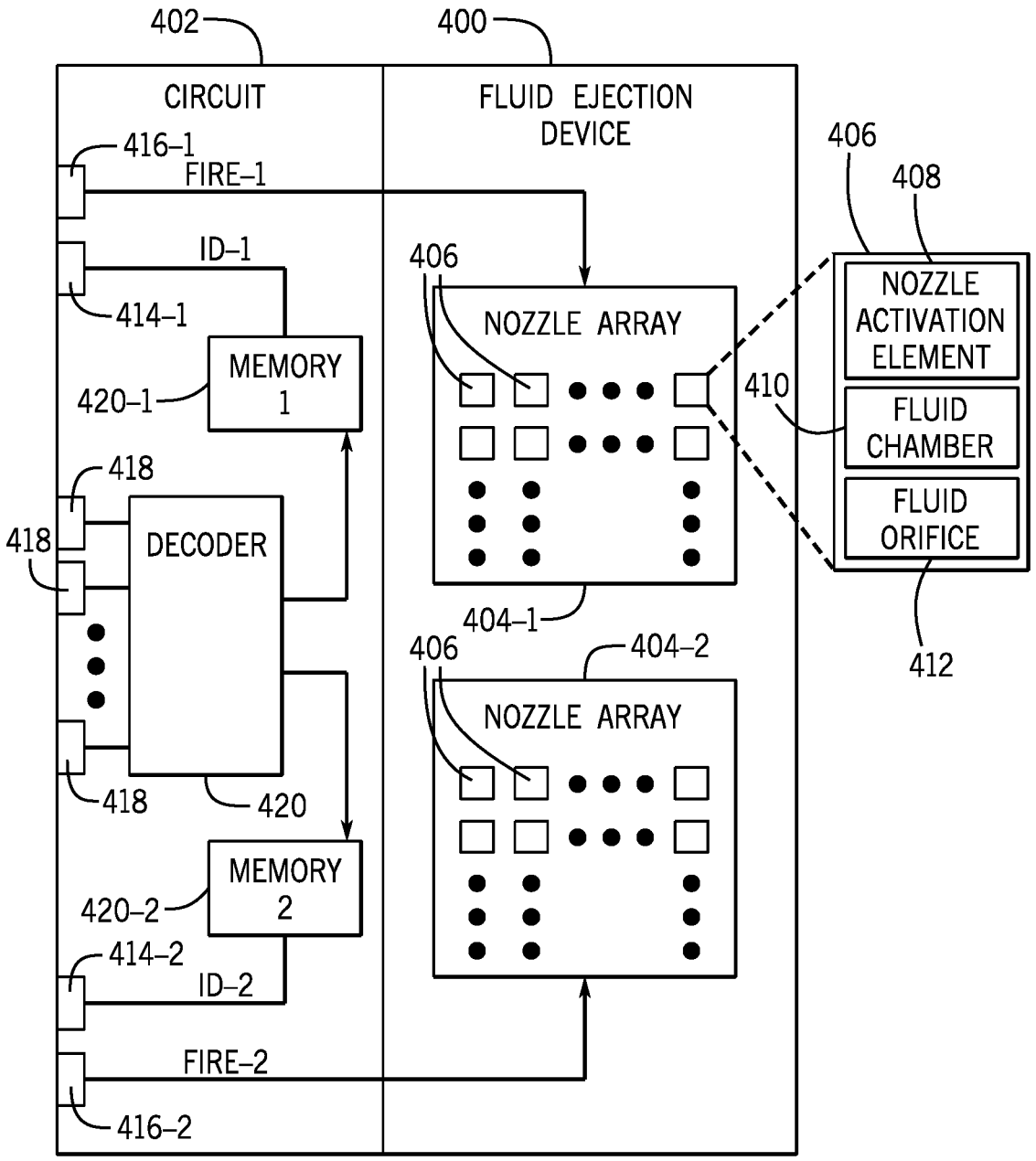

FIG. 4 is a block diagram of another example arrangement that includes a fluid ejection device 400 and a circuit 402 for the fluid ejection device 400. The circuit 402 can be part of or separate from the fluid ejection device 400. The fluid ejection device 400 includes nozzle arrays 404-1 and 404-2. Each nozzle array 404-1 or 404-2 includes an array of nozzles 406. Each nozzle 406 includes a nozzle activation element 408, a fluid chamber 410, and a fluid orifice 412.

The circuit 402 includes ID pads 414-1 and 414-2, to connect to respective ID-1 and ID-2 lines (similar to the ID-1 and ID-2 lines shown in FIG. 2) that connect to the fluid ejection controller (e.g., 202 in FIG. 2).

In addition, the circuit 402 includes fire pads 416-1 and 416-2, which provide respective FIRE-1 and FIRE-2 signals to corresponding nozzle arrays 404-1 and 404-2. For example, the fire pad 416-1 can receive the FIREA-1 or FIREB-1 signal of FIG. 2, and the fire pad 416-2 can receive the FIREA-2 or FIREB-2 signal of FIG. 2.

The circuit 402 further includes address pads 418 to receive address bits. The address bits are received by an address decoder 420, which produces address select signals provided to select respective cells in the memories 420-1 and 420-2.

Figure 5:
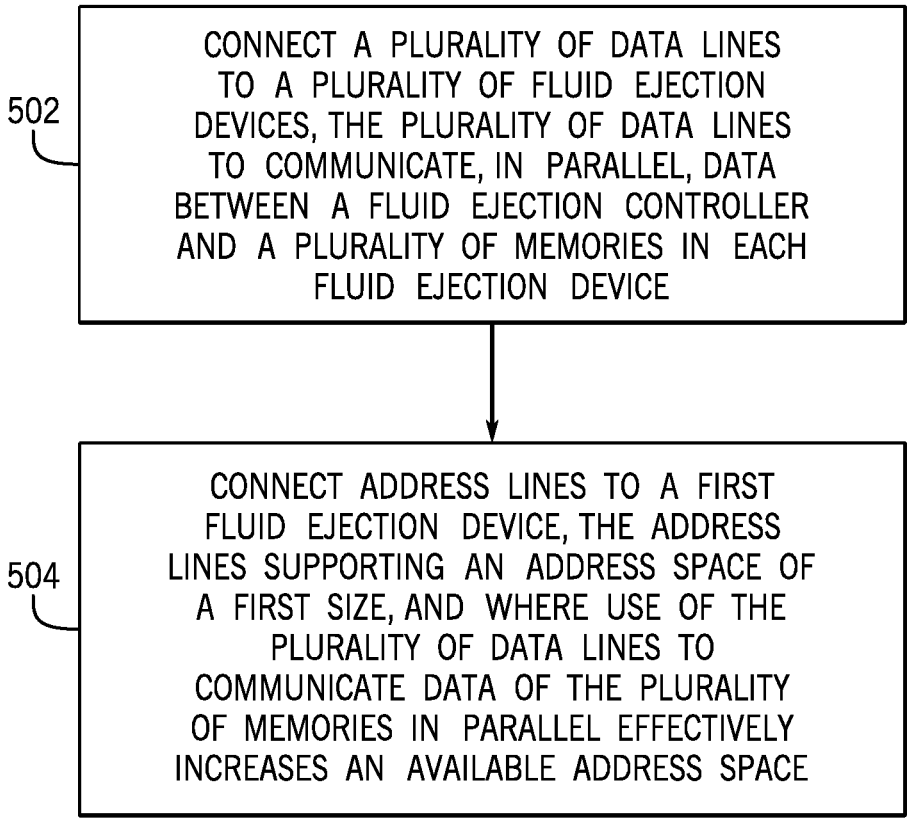
FIG. 5 is a flow diagram of a process according to some examples.

FIG. 5 is a flow diagram of a process of forming a circuit for a fluid dispensing system, according to some examples. The process includes connecting (at 502) a plurality of data lines to a plurality of fluid ejection devices, the plurality of data lines to communicate, in parallel, data between a fluid ejection controller and a plurality of memories in each fluid ejection device of the plurality of fluid ejection devices.

The process further includes connecting (at 504) address lines to a first fluid ejection device of the plurality of fluid ejection devices, the address lines supporting an address space of a first size, wherein use of the plurality of data lines to communicate data of the plurality of memories in parallel effectively increases an available address space to a size greater than the first size. The plurality of fluid ejection devices are addressed to avoid multiple fluid ejection devices being active concurrently on a data line of the plurality of data lines, to avoid data corruption. In some examples, the data in memories of different fluid ejection devices can be independent of one another (i.e., the data in the memories of the different fluid ejection devices are associated with different address spaces). The data stored in a first fluid ejection device can be completely or partially independent of the data stored in a second fluid ejection device.

Interleaved Access Implementations

In alternative examples, interleaved access implementations can be used instead of the multi-data line implementations discussed above. In further examples (discussed further below), a combination of multi-data line implementations and interleaved access implementations can be employed.

With interleaved access, multiple decoders are used to access respective different memories in an interleaved manner in response to a same address (i.e., a single address). In other words, in response to the single address (or common address), the multiple address decoders can select the respective memories at different times to cause the communication of data with the different memories at the different times. Interleaving access of memories refers to communicating data over a specific data line in different time intervals with corresponding different memories. For example, the interleaved access can include performing the following over a data line in response to a common address: communicate data (read data or write data) of a first memory in a first time interval, communicate data of a second memory in a second time interval, and so forth.

Figure 6:
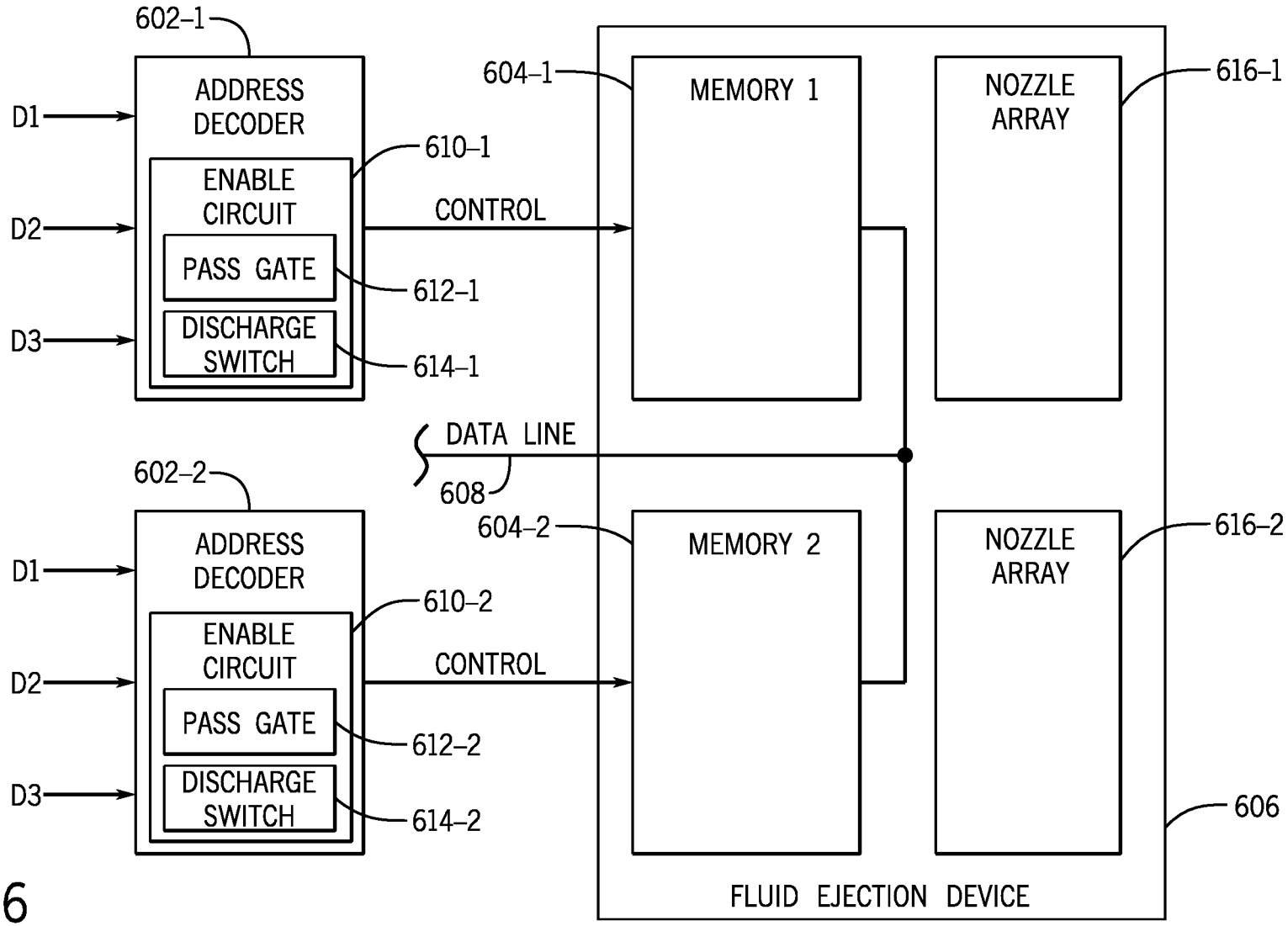
FIG. 6 is a block diagram of an arrangement including address decoders and a fluid ejection device, to support interleaved memory access according to alternative examples.

FIG. 6 is a block diagram of an example arrangement that includes address decoders 602-1 and 602-2, for accessing respective memories 604-1 and 604-2 of a fluid ejection device 606. The address decoders 602-1 and 602-2 each receives an address input, over the following address data lines: D1, D2, D3. Although specific address data lines are identified, it is noted that in other examples, each address decoder 602-1 or 602-2 can receive additional or alternative address data lines, as well as possibly select lines.

In response to the same address provided on D1, D2, and D3, the address decoder 602-1 and 602-2 can access data of the memories 604-1 and 604-2, respectively, in an interleaved manner over a data line 608 (e.g., an ID line). To enable the interleaved access, each address decoder includes a respective enable circuit. The address decoder 602-1 includes an enable circuit 610-1, and the address decoder 602-2 includes an enable circuit 610-2. The enable circuit 610-1 includes a pass gate 612-1 and a discharge switch 614-1. Similarly, the enable circuit 610-2 includes a pass gate 612-2 and a discharge switch 614-2.

In examples where the address decoder 602-1 or 602-2 includes shift registers, where each shift register has multiple shift register cells, a pass gate controls the transfer of a state of an address bit (received over D1, D2, or D3) from one stage of a shift register cell to a select transistor of a memory circuit in a memory. The select transistor (in combination with other select transistors) is activated to enable access of a memory cell in the memory circuit. The discharge switch 614-1 or 614-2 controls a deactivation of a control signal of a respective address decoder 602-1 or 602-2 while the other address decoder is activating a control signal in response to the common address. For example, if the address decoder 602-1 is activating a control signal in response to the address received on D1, D2, and D3 to access data of the memory 604-1, then the discharge switch 614-2 in the address decoder 602-2 deactivates the control signal provided by the address decoder 602-2 to the memory 604-2, to deactivate access of the memory 604-2 while the address decoder 602-1 is enabling access of the memory 604-1.

Similarly, if the address decoder 602-2 is activating a control signal in response to the address received on D1, D2, and D3 to access data of the memory 604-2, then the discharge switch 614-1 in the address decoder 602-1 deactivates the control signal provided by the address decoder 602-1 to the memory 604-1, to deactivate access of the memory 604-1 while the address decoder 602-2 is enabling access of the memory 604-2.

The pass gate 612-1 or 612-2 in each enable circuit isolates dynamic memory nodes of a shift register cell. As explained further below, the isolation provided by the pass gate 612-1 or 612-2 ensures that address data that is being shifted will not be lost due to discharge performed by the discharge switch 614-1 or 614-2, respectively.

In examples where a shift register includes multiple shift register cells, each shift register cell can include a respective enable circuit that has a pass gate and a discharge switch.

In some examples, the control signals provided by each address decoder 602-1 or 602-2 to a respective memory 604-1 or 604-2 includes a row select signal, a column select signal, and a bank select signal. A row select signal selects a row of the memory, a column select signal selects a column of the memory, and a bank select signal selects a bank (from multiple banks) of the memory. Each memory can be arranged as multiple banks, where each bank has an array of rows and columns of memory cells. The row, column, and bank select signals are also referred to as control signals that control selection of a memory.

The address on D1, D2, and D3 received by the address decoder 602-1 or 602-2 can perform row, column, and bank select as follows: the address bit on D1 is used to control the row select signal, the address bit on D2 is used to control the column select signal, and the address bit on D3 is used to control the bank select signal.

In examples where the address decoder 602-1 or 602-2 includes shift registers, then a first shift register can be used to shift the address bit on D1 through the first shift register in successive cycles, a second shift register can be used to shift the address bit on D2 through the second shift register in successive cycles, and a third shift register can be used to shift the address bit D3 through the third shift register in successive cycles.

Each shift register includes a series of shift register cells, which can be implemented as flip-flops, other storage elements, or any sample and hold circuits (such as circuits to pre-charge and evaluate address data bits) that can hold their values until the next selection of the storage elements. The output of one shift register cell in the series can be provided to the input of the next shift register cell top perform data shifting through the shift register. By using shift registers in the address decoder 602-1 or 602-2, a small number of address data bits, e.g., D1, D2, and D3, can be used to select a larger address space. For example, each shift register can include 8 (or any other number of) shift register cells. Assuming that three address data bits are input to the address decoder 602-1 or 602-2 that includes three shift registers, each of length 8, then the address space that can be addressed by the address decoder 602-1 or 602-2 is 512 bits (instead of just 8 bits if the three address bits D1, D2, and D3 are used without using the shift registers).

An enable circuit 610-1 or 610-2 can be included in shift register cells of just one of the multiple shift registers, or alternatively, can be included in shift register cells of the multiple shift registers of the address decoder 602-1 or 602-2.

As further shown in FIG. 6, the fluid ejection device 606 has nozzle arrays 616-1 and 616-2, where each nozzle array includes an array of nozzles for dispensing fluid. The nozzle arrays 616-1 and 616-2 can be activated to control ejection of fluid droplets.

Figure 7:
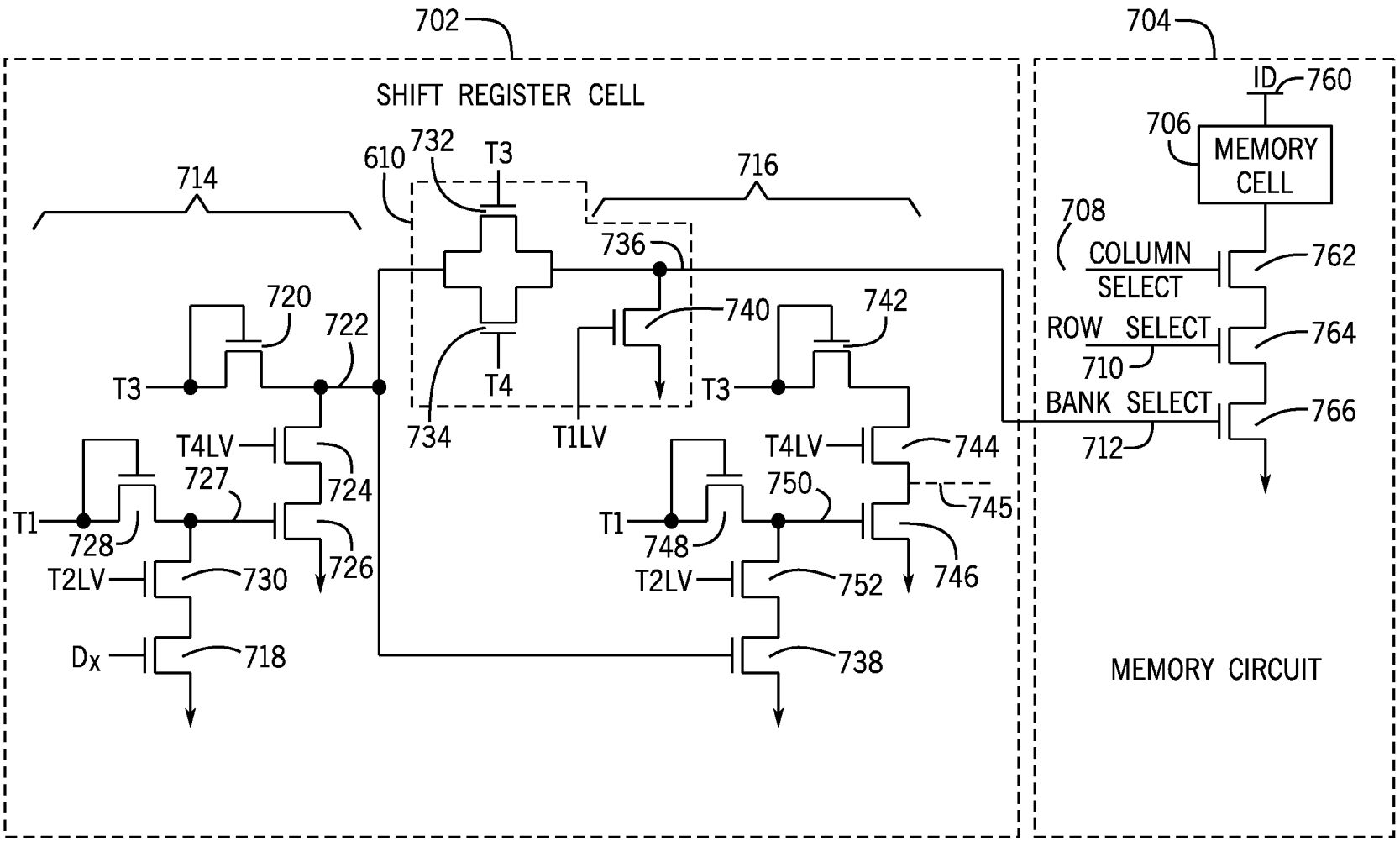
FIG. 7 is a schematic diagram of a shift register cell and a memory circuit according to further examples.

FIG. 7 shows an example of a shift register cell 702 and a memory circuit 704 that is associated with a memory cell 706 of a memory 604-1 or 604-2. The shift register cell 702 is a part of a shift register in an address decoder 602-1 or 602-2. Note that there are multiple shift register cells in each shift register. The shift register cell 702 that is shown in FIG. 7 is to use in controlling a bank select signal 712 provided to the memory circuit 704. Other shift registers are used to control a row select signal 710 and a column select signal 708 to the memory circuit 704.

The shift register cell 702 includes an enable circuit 610 (which is either the enable circuit 610-1 or 610-2 of FIG. 6). The shift register cell 702 includes a first stage 714 and a second stage 716. The address bit that is to be shifted by the shift register cell 702 is Dx (one of D1, D2, or D3 in FIG. 6). Dx is provided to the gate of a transistor 718 in the first stage 714. The second stage 716 provides the data for the next stage of the shift register, while the first stage 714 receives the input signal (on Dx).

The first stage 714 further includes a pre-charge transistor 720. The gate of the pre-charge transistor 720 is connected to a drain of the pre-charge transistor 720. A signal T3 is provided to the drain of the pre-charge transistor 720. The source of the pre-charge transistor 720 is connected to an output node 722 of the first stage 714. A transistor 724 and a transistor 726 are connected in series between the output node 722 and a reference voltage.

The gate of the transistor 724 is controlled by T4LV, which is a low-voltage version of a signal T4. For example, the voltage level of T4LV can be half that (or some other percentage) of the voltage of T4. For example, T4LV can be produced by passing T4 through a voltage divider. The gate of the transistor 726 is connected to a node 727 that is connected to the source of a pre-charge transistor 728 that has a gate connected to a drain that is in turn connected to the signal T1. The gate of the transistor 726 is pre-charged by T1 through the pre-charge transistor 728. A transistor 730 and the transistor 718 are connected in a series between the node 727 and a reference voltage. The gate of the transistor 730 is controlled by T2LV, which is a low-voltage version of a T2 signal.

The output node 722 of the first stage 714 is provided through the pass gate of the enable circuit 610 to a select node 736 that controls the gate of a transistor 766 in the memory circuit 704. In the example of FIG. 7, the select node 736 provides a bank select signal to the gate of the transistor 766. The transistor 766 and transistors 762 and 764 are connected in series between the memory cell 706 and a reference voltage. The gate of the transistor 764 is driven by the row select signal (from another shift register), and the gate of the transistor 762 is driven by the row select signal (from a further shift register)

The pass gate of the enable circuit 610 includes two parallel transistors 732 and 734 that are connected in parallel between the output node 722 of the first stage 714 and the select node 736, which is connected to the gate of the transistor 766. The transistor 732 of the pass gate is controlled by a signal T3, and the gate of the transistor 734 is controlled by the signal T4. When either T3 or T4 is at an active state (e.g., a high state), the corresponding transistor 732 or 734 is turned on to allow the voltage at the output node 722 of the first stage 714 to pass to the select node 736.

The pass gate including the pass gate transistors 732 and 734 controls when the output node 722 of the first stage 714 is connected to or isolated from the select node 736. If the signals T3 and T4 are both at an inactive state (e.g., a low state), the pass gate transistors 732 and 734 are both off so that the first stage 714 is isolated from the gate of the select transistor 766.

The discharge switch of the enable circuit 610 is implemented as a transistor 740, which is connected between the select node 736 and a reference voltage. The gate of the transistor 740 is connected to a T1LV signal, which is a low-voltage version of the T1 signal. The transistor 740 when activated by T1LV discharges the gate of the transistor 766 to turn off the select transistor 766, which effectively disables the memory circuit 704.

The output node 722 of the first stage 714 is further provided to the gate of a transistor 738. The transistor 738 is part of the second stage 716, which also includes other transistors, including a pre-charge transistor 742. The pre-charge transistor 742 has a gate connected to a drain of the transistor 742, which is driven by the T3 signal. Transistors 744 and 746 are connected in series between the source of the pre-charge transistor 742 and a reference voltage. The common node 745 between the transistors 744 and 746 is output to the next shift register cell of the shift register, to shift the value of Dx to the next shift register cell.

The gate of the transistor 744 is driven by the T4LV signal, and the gate of the transistor 746 is driven through a pre-charge transistor 748. The T1 signal is provided through the pre-charge transistor 748 to a gate node 750. Transistors 752 and 738 are connected in series between the gate node 750 and a reference voltage. The gate of the transistor 752 is connected to the T2LV signal.

The pass gate transistors 732 and 734 of the enable circuit 610 isolate dynamic memory nodes of the shift register cell 702. In the example of FIG. 7, the dynamic memory nodes are the first stage output node 722 and the select node 736 at the output of the pass gate including the parallel transistors 722 and 734. The isolation provided by the pass gate transistors 732 and 734 ensures that the data that is being shifted will not be lost due to discharge performed by the discharge transistor 740 in response to activation of T1LV.

For example, when the T3 signal is set to an active state (e.g., a high state), both the first stage output node 722 (of the first stage 714) and the select node 736 (that controls the select transistor 766 in the memory circuit 704) are charged to an active state, and the nodes 722 and 736 will remain charged so long as T4 is not activated to perform a discharge. However, the select node 736 will be discharged when T1LV is set to an active state, while the first stage output node 722 remains unchanged at T1LV (in other words, if the first stage of the node 722 is initially high, it will remain high). This isolation between the nodes 722 and 736 is performed to ensure that shifting data through the shift register that includes the shift register cell 702 does not cause loss of data.

Various signals are depicted as being provided to transistors in the first and second stages of the shift register cell 702. These signals include T1, T2LV, T3, and T4LV. In FIG. 7, T1LV is a low-voltage version of T1.

The signals T1, T2LV, T3, and T4LV are connected to different combinations of select signals depending on whether the shift register cell 702 is in the address decoder 602-1 or address decoder 602-2 (FIG. 6).

Table 1 below sets forth how the signals T1, T2LV, T3, and T4LV in FIG. 7 are connected to respective select signals. These select signals are used to select nozzles of a nozzle array or a memory element of a memory.

TABLE 1

| SIGNAL | 602-1 | 602-2 |
|---|---|---|
| T1 | S1 | S3 |
| T2LV | S2LV | S4LV |
| T3 | S3 | S1 |
| T4LV | S4LV | S2LV |

According to Table 1, signals T1, T2LV, T3, and T4LV of the shift register cell 702 are connected to respective select signals S1, S2LV, S3, and S4LV in the address decoder 602-1. The signals T1, T2LV, T3, and T4LV in the shift register cell 702 of FIG. 7 are connected to the respective select signals S3, S4LV, S1, and S2LV in the address decoder 602-2.

In FIG. 7, the first stage of the shift register cell 702 evaluates the Dx address in response to activation of the T2LV signal. Note that the T2LV signal is connected to different select signals, S2LV and S4LV, respectively, in the address decoder 602-1 and 602-2. Thus, in the address decoder 602-1, the first stage 714 of the shift register cell 702 evaluates the Dx address in response to activation of the S2LV select signal (which controls the gate of the transistor 716), and in the address decoder 602-2, the first stage 714 of the shift register cell 702 evaluates the Dx address in response to activation of the S4LV select signal (which controls the gate of the transistor 716).

The pass gate transistors 732 and 734 are controlled by the T3 and T4 signals, respectively. In the address decoder 602-1, T3 and T4 are connected to S3 and S4, respectively, and in the address decoder 602-2, T3 and T4 are connected to S1 and S2, respectively.

The discharge switch 740 is controlled by T1LV. In the address decoder 602-1, T1LV is connected to S1LV, and in the address decoder 602-2, T1LV is connected to S3LV.

As further shown in FIG. 7, the memory circuit 704 depicts the memory cell 706 connected to the ID line 760. Data can be read from the memory cell 706 over the ID line 760, and data can be written to the memory cell 706 over the ID line 750. When the transistors 762, 764, and 766 are all activated by the respective column select signal 708, row select signal 710, and bank select signal 712, then the memory circuit 704 is selected, and data can be written to or read from the memory cell 706 over the ID line 760.

If any of the column select signal 708, the row select signal 710, and the bank select signal is set to an inactive state (e.g., a low state), then the memory cell 706 is not selected since the corresponding transistor 762, 764, or 766 would be off.

Figure 8:
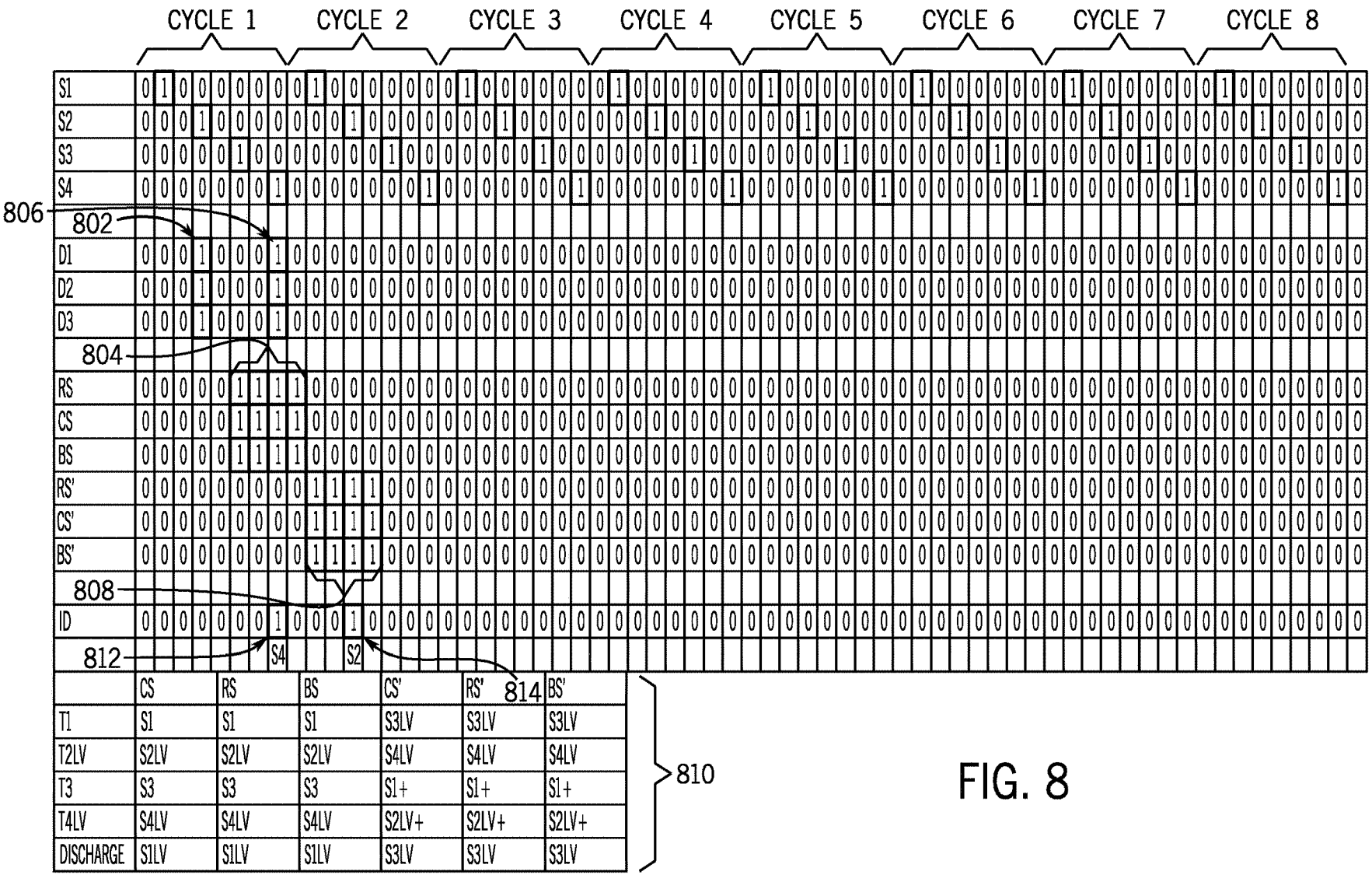
FIG. 8 is a timing diagram of an operation for interleaved memory access according to further examples.

FIG. 8 is a timing diagram showing states of various signals over time. A "0" state in FIG. 8 depicts an inactive state of the signal at the corresponding time, while a "1" state depicts an active state of the corresponding signal at the corresponding time. The horizontal axis of FIG. 8 corresponds to the time axis.

In the FIG. 8 example, it is assumed that each shift register of an address decoder (e.g., 602-1 or 602-2 in FIG. 6) includes eight shift register cells. To cause a respective address bit, D1, D2, or D3, to be propagated through the eight shift register cells, eight cycles are used. In the example of FIG. 8, it is assumed that the memory cell corresponding to the first shift register cell of each of the row select shift register, column select shift register, and bank select shift register is active. As depicted in FIG. 8, within each cycle, the S1, S2, S3, and S4 signals are set to respective active states in corresponding sub-intervals of the cycle.

The D1, D2, and D3 address bits all set to an active state at 802 causes the row select (RS), column select (CS), and bank select (BS) signals of the address decoder 602-1 to be active in time interval 804. The D1, D2, and D3 address bits all set active at time 806 causes the row select (RS'), column select (CS'), and bank select (BS') signals of the address decoder 602-2 to be set active in time interval 808.

Table 810 in FIG. 8 shows mappings between the signals T1, T2LV, T3, and T4LV and corresponding select signals, similar to Table 1.

As further shown in FIG. 8, the data from the memory 604-1 selected by the address decoder 602-1 is output at time 812 on the ID line, and the data from the memory 604-2 selected by the address decoder 602-2 is output on the ID line at time 814. The data from the memory 604-1 is output in response to the S4 signal being set active, and the data from the memory 604-2 is output in response to the S2 signal being set active.

Figure 10:
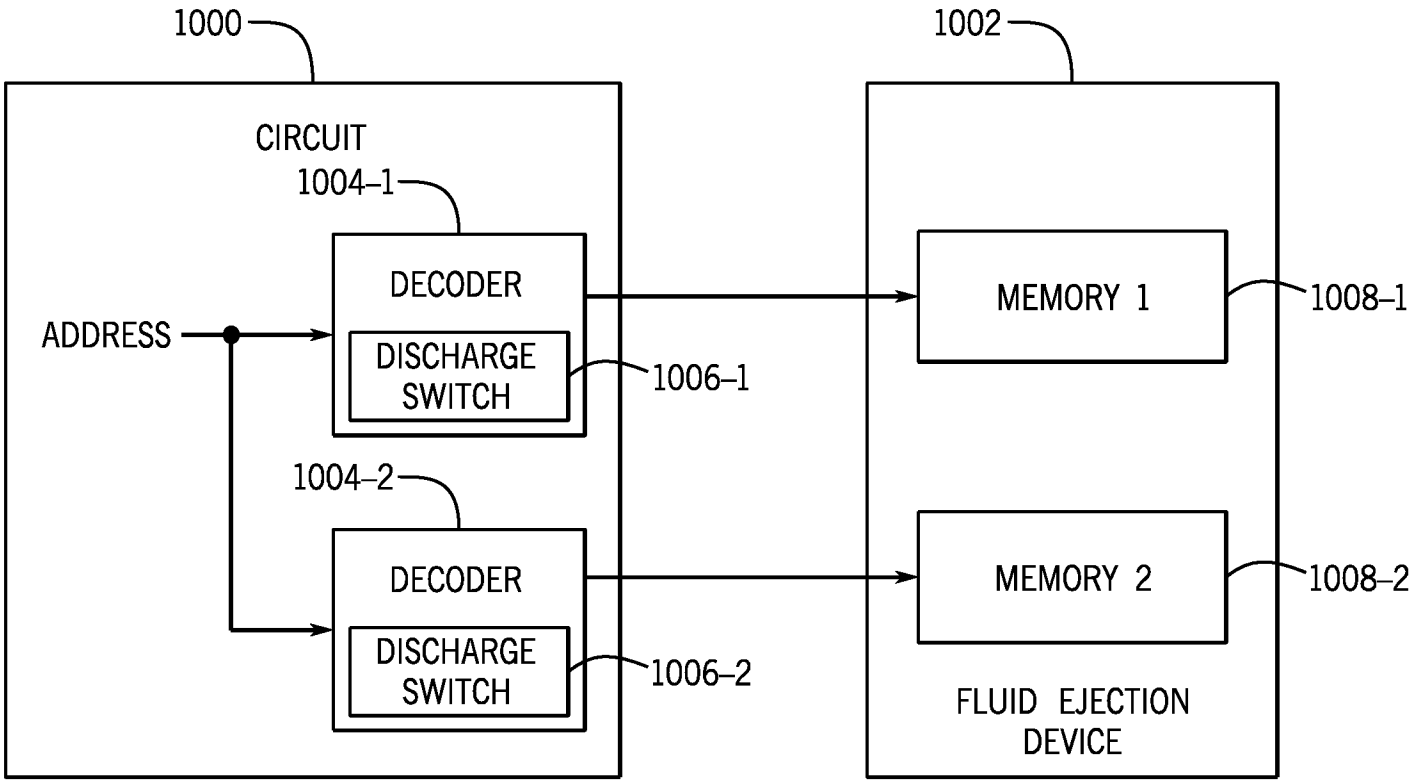
FIGS. 10 and 11 are block diagrams of arrangements each including a circuit and a fluid ejection device, to support interleaved memory access according to further examples.

FIG. 10 shows an example arrangement according to further implementations. FIG. 10 depicts a circuit 1000 for use with a fluid ejection device 1002. The circuit 1000 includes a plurality of decoders 1004-1 and 1004-2 responsive to a common address to activate respective control signals at different times for selecting respective memories 1008-1 and 1008-2 of the fluid ejection device 1002. Each respective decoder 1004-1 or 1004-2 includes a discharge switch 1006-1 or 1006-2 to deactivate a control signal of the respective decoder, while another decoder is activating a control signal in response to the common address.

Figure 11:
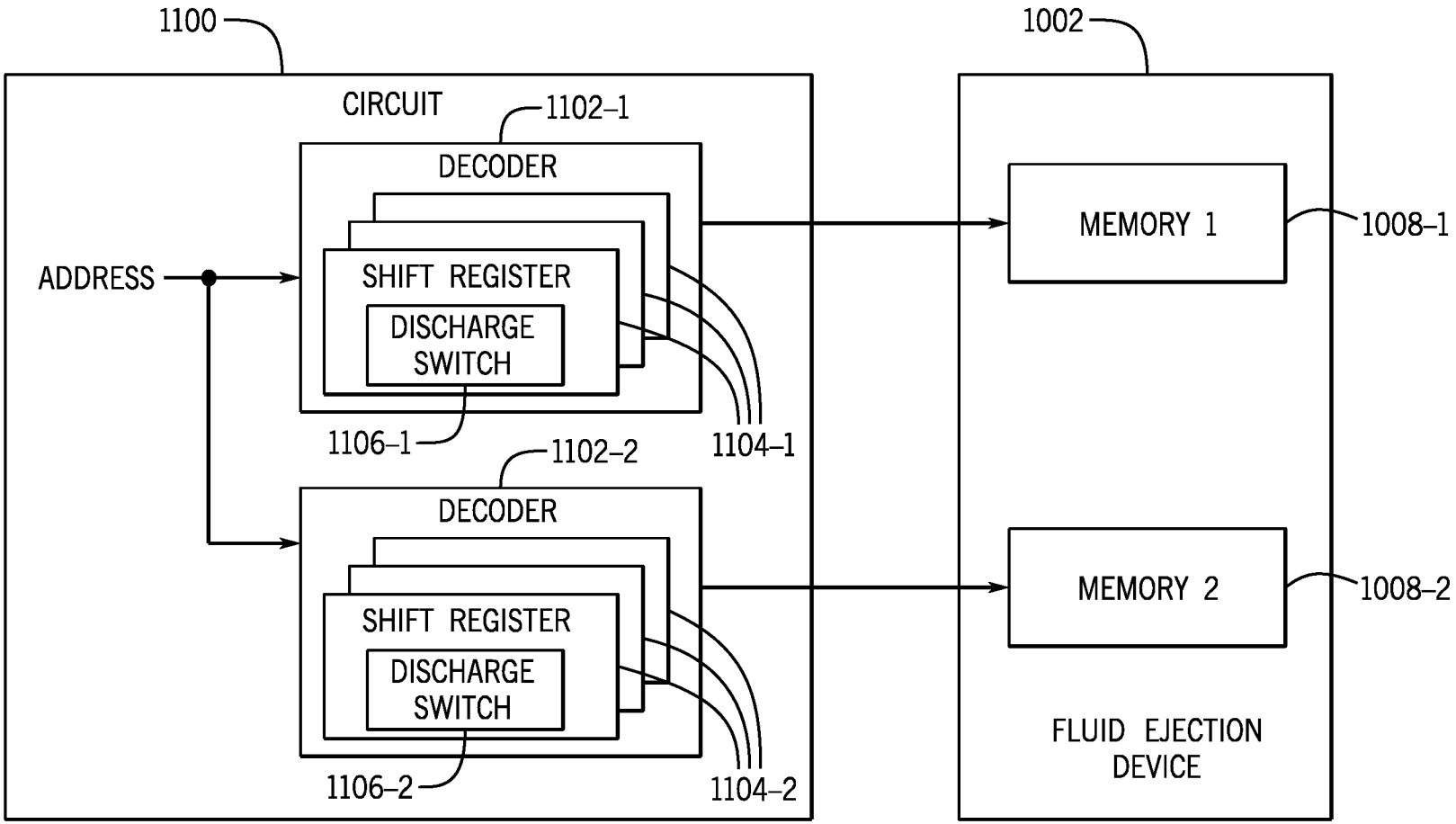

FIG. 11 shows another example arrangement according to additional implementations. FIG. 11 depicts a circuit 1100 for use with a fluid ejection device 1002 includes a plurality of decoders 1102-1 and 1102-2 each including shift registers 1104-1 and 1104-2 to receive respective address bits. The plurality of decoders 1102-1 and 1102-2 are responsive to a common address on the address bits to activate respective control signals at different times for selecting respective memories 1008-1 and 1008-2 of the fluid ejection device 1002. A shift register 1104-1 of the first decoder 1104-1 includes a discharge switch 1106-1 to deactivate a control signal of the first decoder 1104-1, while the second decoder 1104-2 is activating a control signal in response to the common address.

Figure 12:
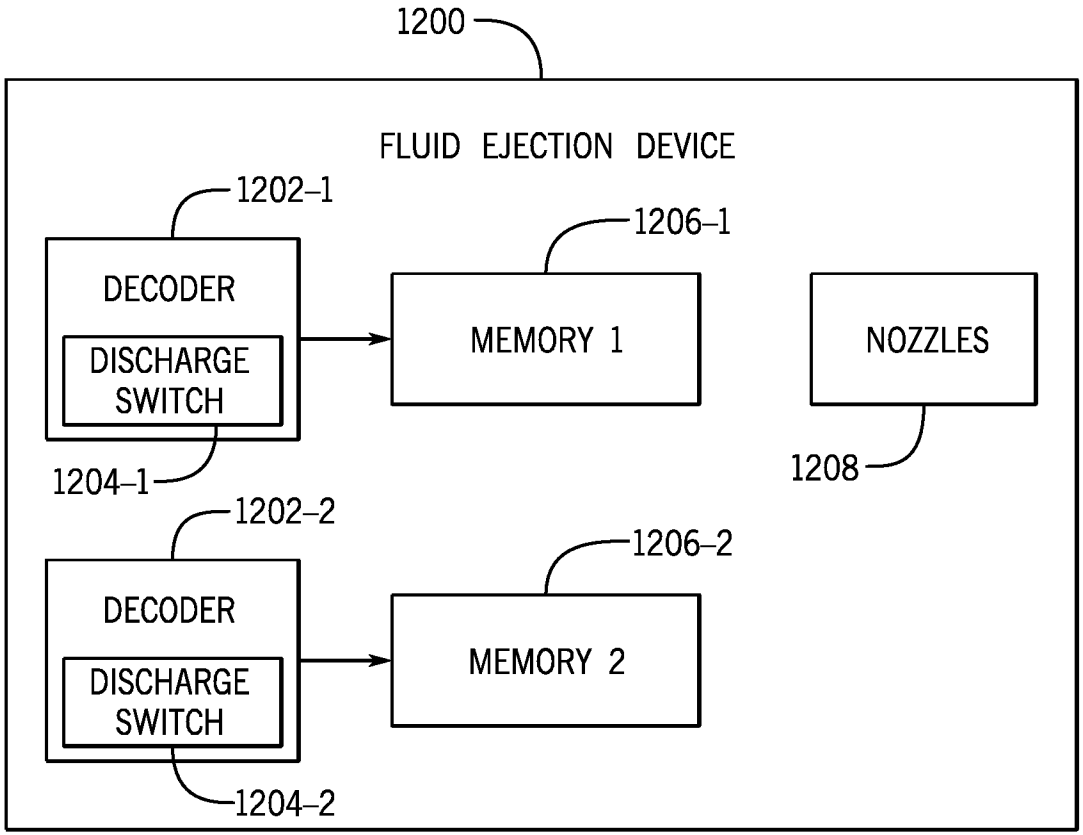
FIG. 12 is a block diagram of a fluid ejection device according to additional examples.

FIG. 12 is a block diagram of a fluid ejection device 1200 that includes nozzles 1208 to dispense fluid, a plurality of memories 1206-1 and 1206-2, and a plurality of decoders 1202-1 and 1202-2 responsive to a common address to activate respective control signals at different times for selecting respective memories 1206-1 and 1206-2. Each respective decoder 1202-1 or 1202-2 includes a discharge switch 1204-1 or 1204-2 to deactivate a control signal of the respective decoder while another decoder of the plurality of decoders is activating a control signal in response to the common address.

Other Example Arrangements

FIGS. 9A-9D illustrate various example arrangements of multiple ID memories implemented on a fluid ejection die 904. The fluid ejection die 904 includes nozzles for ejection fluid droplets, and is controlled by a fluid ejection controller 900.

Figure 9B:
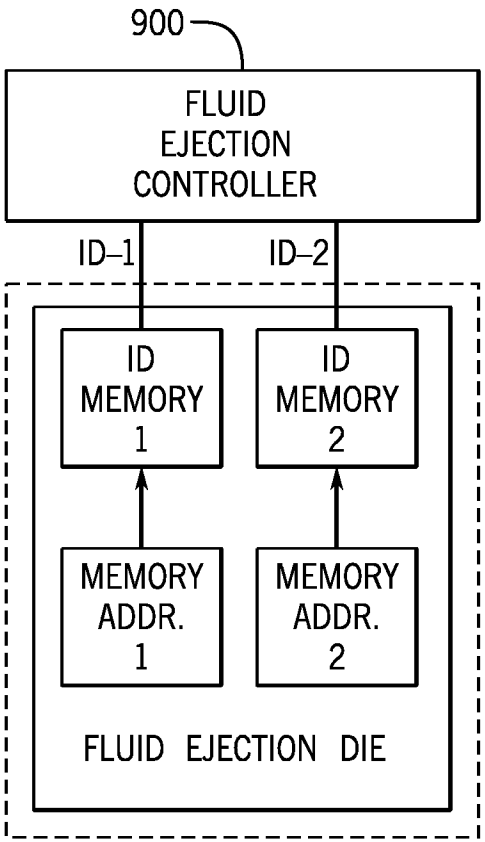
FIGS. 9A-9G are block diagrams of systems according to various examples.
Figure 9A:
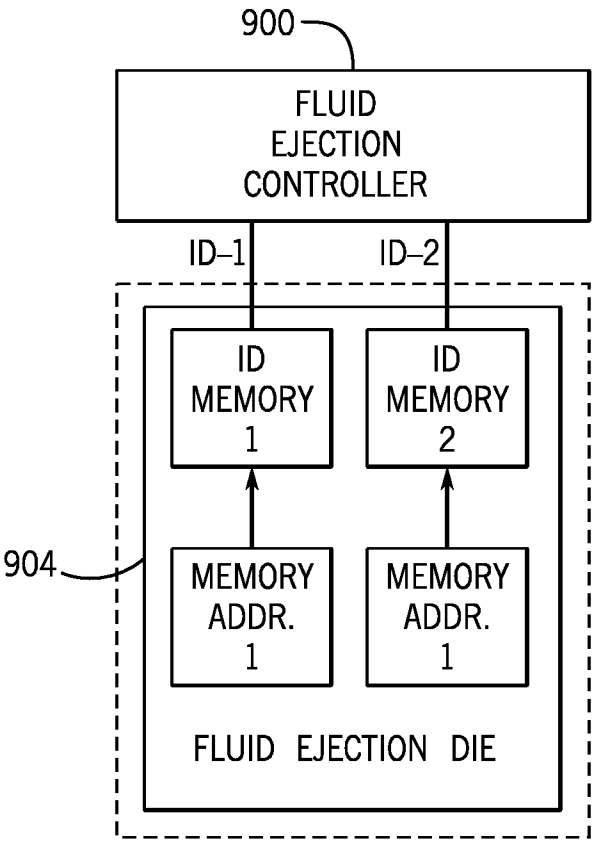

As shown in FIG. 9A, ID memory 1 and ID memory 2 are connected to respective ID lines ID-1 and ID-2. This is an example of a multi-ID line arrangement, where the ID-1 and the ID-2 lines can be shared by memories in multiple fluid ejection dies, and can be used to communicate data of multiple memories in parallel. In each of FIGS. 9A-9D, "MEMORY ADDR 1" and "MEMORY ADDR 2" each represents a memory address decoder.

Each memory address decoder shown in FIGS. 9A-9D can be an interleaved address decoder with shift registers using enable circuits 610-1 and 610-2 as discussed above in connection with FIGS. 6-8, a memory address decoder that uses shift registers as discussed in connection with FIGS. 6-8 but without the enable circuits 610-1 and 610-2, or an address decoder (referred to as a direct address decoder) that does not employ shift registers but instead produces select signals in response to an input address.

In FIG. 9A, the same memory address decoder (MEMORY ADDR 1) is duplicated for respective access of ID memory 1 and ID memory 2. The arrangement of FIG. 9A is a multi-ID line with mirror address decoder arrangement.

FIG. 9B depicts the use of multiple ID lines and two different memory address decoders (MEMORY ADDR 1 and MEMORY ADDR 2) that can independently address the respective ID memory 1 and ID memory 2. In each of FIGS. 9A and 9B, there is a one-to-one correspondence between a memory address decoder and an ID memory.

Figure 9D:
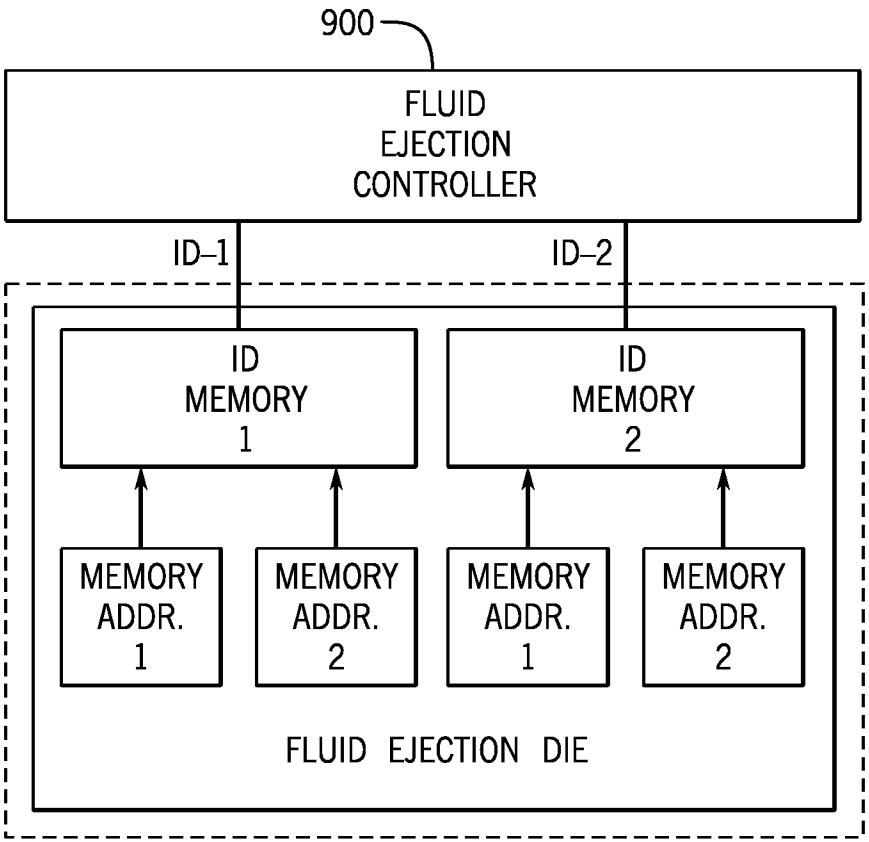
Figure 9C:
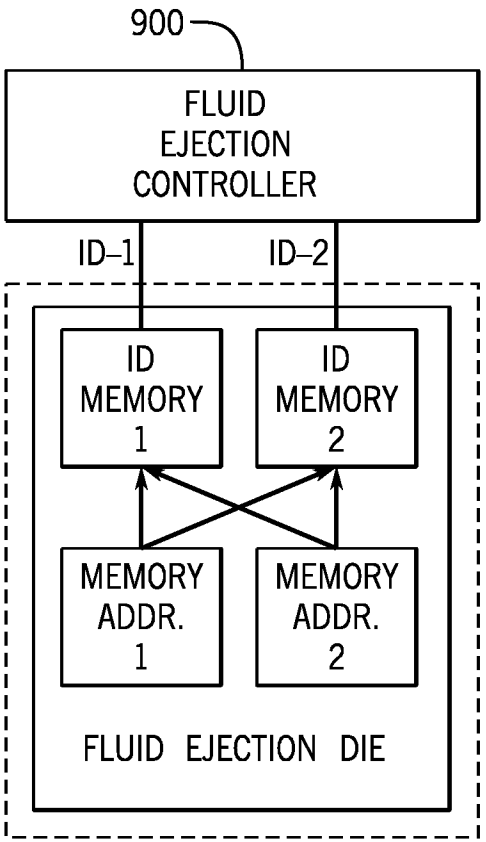

FIG. 9C shows an alternative arrangement, which uses multiple ID lines and multiple memory address decoders that each can access both ID memory 1 and ID memory 2. This is an example of a hybrid memory addressing scheme, in which two memory address decoders are used.

FIG. 9D shows a different example of a hybrid memory addressing scheme, where four memory address decoders are used, with a first set of MEMORY ADDR1 and MEMORY ADDR2 being used to access ID memory 1, and another set of MEMORY ADDR1 and memory ADDR2 being used to access ID memory 2.

Figure 9F:
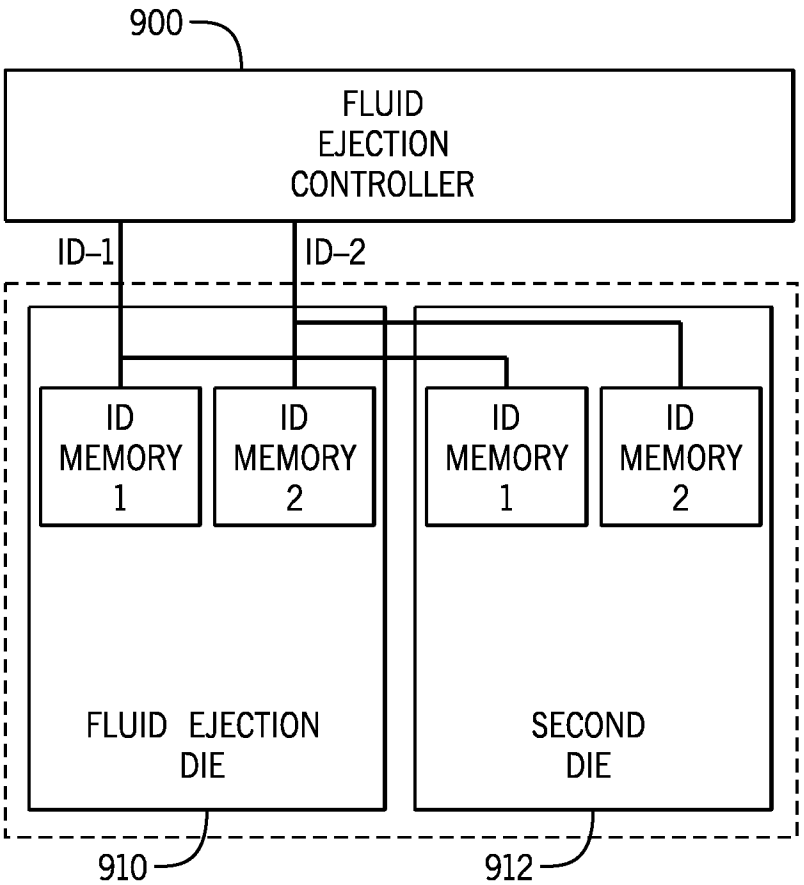
Figure 9E:
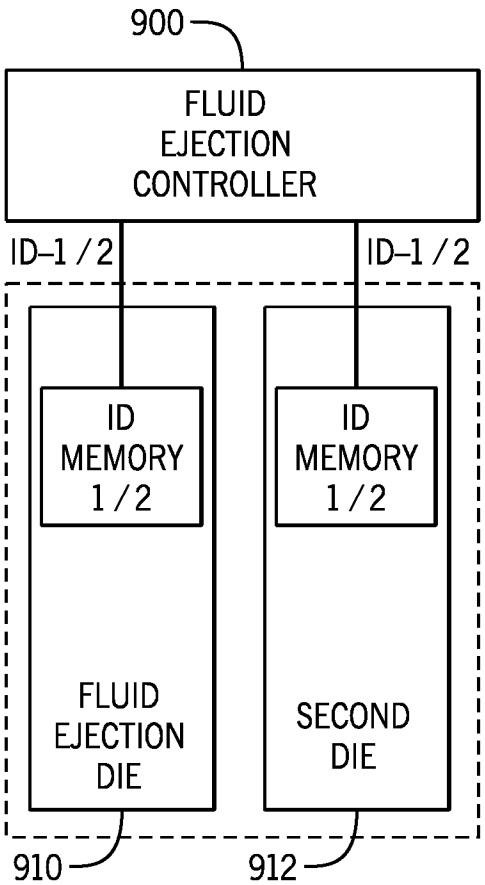
Figure 9G:
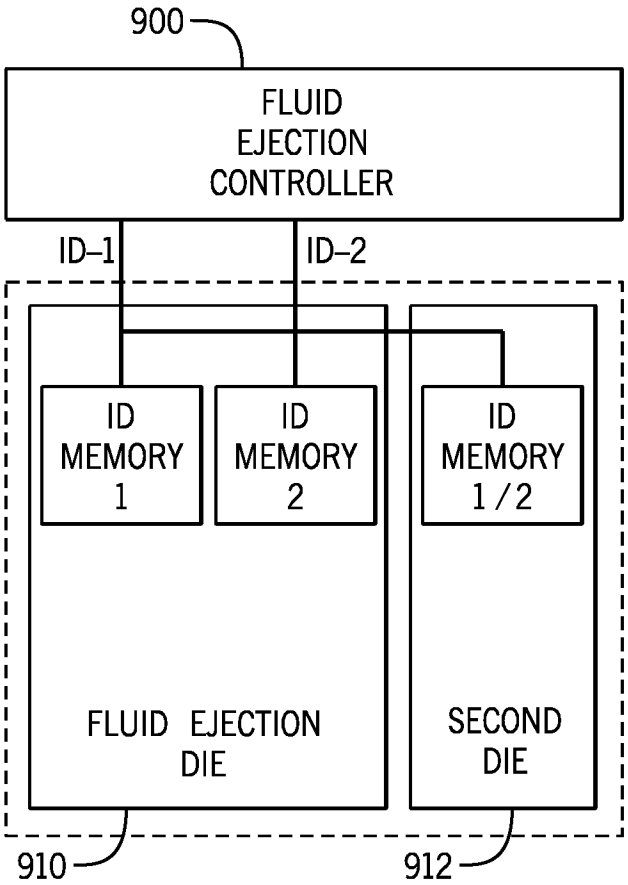

FIGS. 9E-9G illustrate multi-die arrangements that employ the multi-ID lines. Although FIGS. 9E-9G do not show the memory address decoders, memory address decoders similar to those of FIGS. 9A-9D can be used.

In FIG. 9E, ID memory 1 or 2 can be on fluid ejection die 910, and ID memory 1 or 2 can be on a second die 912. The ID line from the fluid ejection controller 900 to the fluid ejection die 910 can be ID-1 or ID-2, and similarly, the ID line from the fluid ejection controller 900 to the second die 912 can be ID-1 or ID-2. Thus, two possible combinations are possible for FIG. 9E: (1) in the fluid ejection die 910, ID memory 1 is connected to ID-1, and in the second die 912, ID memory 2 is connected to ID-2; or (2) in the fluid ejection die 910, ID memory 2 is connected to ID-1, and in the second die 912, ID memory 1 is connected to ID-2.

FIG. 9F shows an arrangement where ID memory 1 and ID memory 2 is provided on the fluid ejection die 910, and ID memory 1 and ID memory 2 are provided on the second die 912. The ID-1 line is connected to each of ID memory 1 in the fluid ejection die 910 and the second die 912, and the ID-2 line is connected to ID memory 2 in the fluid ejection die 910 and ID memory 2 in the second die 912.

FIG. 9G illustrates an example where the fluid ejection die 910 has ID memory 1 and ID memory 2, connected to the ID-1 and ID-2 lines, respectively. The second die 912 includes either ID memory 1 or 2, and can be connected to the respective one of ID-1 and ID-2.

In the foregoing description, numerous details are set forth to provide an understanding of the subject disclosed herein. However, implementations may be practiced without some of these details. Other implementations may include modifications and variations from the details discussed above. It is intended that the appended claims cover such modifications and variations.

What is claimed is:

1. A circuit for use with a fluid ejection device, comprising:

a plurality of decoders responsive to a common address to activate respective control signals at different times for selecting respective memories of the fluid ejection device, each respective decoder of the plurality of decoders comprising:

a discharge switch to deactivate a control signal of the respective decoder while another decoder of the plurality of decoders is activating a control signal in response to the common address, and a pass gate between the respective decoder and a select transistor of a memory circuit of the memories, the pass gate to isolate the respective decoder from the memory circuit in response to the pass gate being off.

2. The circuit of claim 1, wherein each respective decoder further comprises a register that includes the pass gate and the discharge switch.

3. The circuit of claim 2, wherein the register comprises a shift register including a plurality of shift register cells, wherein a first shift register cell of the plurality of shift register cells includes a first stage and a second stage.

4. The circuit of claim 3, wherein the shift register is to shift an address bit through the plurality of shift register cells in corresponding cycles to output as a respective control signal.

5. The circuit of claim 3, wherein the first stage of the first shift register cell is to evaluate the common address in response to activation of a first select signal, and wherein a first stage of a second shift register cell of the plurality of shift register cells is to evaluate the common address in response to activation of a second select signal.

6. The circuit of claim 3, wherein the first stage is to evaluate the common address in response to activation of a first select signal, and the pass gate is to pass an output of the first stage to a gate of the select transistor in response to activation of a second select signal that is activated after the first select signal, and the pass gate to isolate a node of the first stage from the gate of the select transistor so that an address data that is being shifted is not lost due to discharge performed by the discharge switch.

7. The circuit of claim 1, wherein the discharge circuit switch of a first decoder of the plurality of decoders is activated in response to a first select signal, and wherein the discharge switch of a second decoder of the plurality of decoders is activated in response to a second select signal.

8. The circuit of claim 1, wherein the fluid ejection device is a first fluid ejection device, the circuit further comprising:

a plurality of data lines for sharing by a plurality of fluid ejection devices including the first fluid ejection device when the circuit is installed in a system that has the plurality of fluid ejection devices, a first data line of the plurality of data lines to communicate data of a first memory of the first fluid ejection device, and a second data line of the plurality of data lines to communicate data of a second memory of the first fluid ejection device.

9. The circuit of claim 8, wherein:

the first data line is to communicate data of a first memory of a second fluid ejection device of the plurality of fluid ejection devices, and the second data line is to communicate data of a second memory of the second fluid ejection device.

10. The circuit of claim 8, wherein a first decoder of the plurality of decoders is to provide a control signal to the first memory, and a second decoder of the plurality of decoders is to provide a control signal to the second memory.

11. A circuit for use with a fluid ejection device, comprising:

a plurality of decoders each comprising shift registers to receive respective address bits, the plurality of decoders responsive to a common address on the address bits to activate respective control signals at different times for selecting respective memories of the fluid ejection device, a shift register of a first decoder of the plurality of decoders comprising a discharge switch to deactivate a control signal of the first decoder while another decoder of the plurality of decoders is activating a control signal in response to the common address.

12. The circuit of claim 11, wherein a shift register of a second decoder of the plurality of decoders comprises a discharge switch to deactivate a control signal of the second decoder while another decoder of the plurality of decoders is activating a control signal in response to the common address, and wherein the shift register of the first decoder is to be operated by a first combination of select signals, and the shift register of the second decoder is to be operated by a second combination of the select signals.

13. The circuit of claim 11, wherein the shift register of the first decoder comprises a plurality of shift register cells, each respective shift register cell of the plurality of shift register cells comprising a first stage a second stage, and a discharge switch to deactivate the second stage in response to activation of a select signal.

14. The circuit of claim 13, wherein the respective shift register cell further comprises a pass gate to isolate the first stage from a memory circuit when the pass gate is off.

15. A fluid ejection device comprising:

nozzles to dispense fluid;

a plurality of memories; and a plurality of decoders responsive to a common address to activate respective control signals at different times for selecting respective memories of the plurality of memories, each respective decoder of the plurality of decoders comprising a discharge switch to deactivate a control signal of the respective decoder while another decoder of the plurality of decoders is activating a control signal in response to the common address.

16. The fluid ejection device of claim 15, wherein each decoder of the plurality of decoders comprises a shift register that comprises a plurality of shift register cells, each shift register cell including a respective discharge circuit.

17. The circuit of claim 1, wherein a first decoder of the plurality of decoders includes a first stage and a second stage, wherein the first stage is to evaluate the common address in response to activation of a first select signal, and wherein the first stage is to evaluate the common address in response to activation of a second select signal.

18. The circuit of claim 1, wherein a first decoder of the plurality of decoders includes a first stage and a second stage, wherein the first stage is to evaluate the common address in response to activation of a first select signal, and the pass gate of the first decoder is to pass an output of the first stage to a gate of the select transistor in response to activation of a second select signal that is activated after the first select signal, and the pass gate to isolate a node of the first stage from the gate of the select transistor so that an address data is not lost due to discharge performed by the discharge switch.

19. The fluid ejection device of claim 15, wherein each respective decoder further comprises a pass gate between the respective decoder and a select transistor of a memory circuit of the plurality of memories, the pass gate to isolate the respective decoder from the memory circuit in response to the pass gate being off.

20. The fluid ejection device of claim 19, wherein each respective decoder comprises a first stage and a second stage, the first and second stages being part of a shift register cell that is part of a shift register comprising a plurality of shift register cells.

* * * * *